United States Patent [19]

Kinslow

[11] Patent Number: 5,071,015

[45] Date of Patent: Dec. 10, 1991

[54] BLOW MOLDED PET CONTAINER WITH RIBBED BASE STRUCTURE

[75] Inventor: William G. Kinslow, Saline, Mich.

[73] Assignee: Hoover Universal, Inc., Plymouth, Mich.

[21] Appl. No.: 625,444

[22] Filed: Dec. 11, 1990

[51] Int. Cl.[5] ..... B65D 1/02

[52] U.S. Cl. ..... 215/1 C; 220/606; 220/608

[58] Field of Search ..... 215/1 C; 220/606, 608, 220/609; D9/370

[56] References Cited

U.S. PATENT DOCUMENTS

| | | | |
|---|---|---|---|
| 3,727,783 | 4/1973 | Carmichael | 220/608 X |
| 3,871,541 | 3/1975 | Adomaitis | 220/608 X |
| 4,108,324 | 8/1978 | Krishnakumar et al. | 215/1 C |
| 4,301,933 | 11/1981 | Yoshino | 220/606 X |
| 4,355,728 | 10/1982 | Yoshino et al. | 220/606 X |
| 4,403,706 | 9/1983 | Mahajan | 220/606 X |
| 4,850,493 | 7/1989 | Howard, Jr. | 220/606 X |
| 4,850,494 | 7/1989 | Howard, Jr. | 220/606 X |
| 4,867,323 | 9/1989 | Powers | 215/1 C |
| 4,966,780 | 10/1990 | Hargraves et al. | 215/1 C X |
| 4,978,015 | 12/1990 | Walker | 220/608 X |

FOREIGN PATENT DOCUMENTS

| | | | |
|---|---|---|---|
| 0199949 | 4/1989 | Japan | 215/1 C |

*Primary Examiner*—Sue A. Weaver

*Attorney, Agent, or Firm*—Harness, Dickey & Pierce

[57] ABSTRACT

A blow molded PET container is disclosed having a ribbed base structure to provide stiffening of the base structure to prevent undesirable deformation. The container is designed to accommodate moderate internal pressurization of 30 to 50 psi to provide packaging for products which must be contained in a pressurized package but not pressurized to the extent of a carbonated beverage. The reinforcing ribs required in the base structure are thus not as deep as found in ribbed base structures for carbonated beverage containers resulting in less plastic resin required to produce the container. As a result, the container fills a void in the packaging industry between containers for non-pressurized products and containers for highly pressurized carbonated beverages.

5 Claims, 1 Drawing Sheet

BLOW MOLDED PET CONTAINER WITH RIBBED BASE STRUCTURE

BACKGROUND AND SUMMARY OF THE INVENTION

The present invention relates to a blow molded PET container and in particular to a container with a ribbed base structure to support moderate internal container pressures.

In recent years, PET (polyethylene terephthalate) containers have grown in acceptance by consumers. The primary advantages of PET over glass are the significant weight reduction of the container and its durability and shatter resistance. One major area of use of PET is for carbonated beverage bottles. Such bottles must be configured to resist high internal pressures of 75 to 100 psi. The sidewall of the bottles can easily withstand such pressure, however, the base structure must be strengthened by deep ribs or grooves to prevent deformation. Besides carbonated beverages, PET is widely used for products such as peanut butter and mayonnaise that are not packaged under pressure.

However, PET has not been used to package products that require moderate packing pressures such as 30 to 50 psi. Such a container would need some base structure reinforcement not found in unpressurized containers but would not need the reinforcement or wall thickness found in carbonated beverage containers. One product requiring such a container is fresh ground coffee. Ground coffee is typically packaged in pressurized cans or vacuum foil pouches, neither of which can be easily and effectively resealed after opening.

Accordingly, it is the object of the present invention to provide a blow molded PET container for packaging products under moderate internal pressures.

It is an advantage of the present invention to provide a container which can be easily resealed after opening.

The blow molded PET container of the present invention includes a base structure reinforced to prevent deformation, particularly roll-out, caused by internal pressure. The base structure includes an annular outer wall extending downwardly and inwardly from the lower end of the container sidewall and an upwardly raised circular inner wall. The inner and outer walls are merged together at their lower ends. Downwardly projecting reinforcing ribs are molded in the lower portion of the outer wall, through the merger of the inner and outer walls and extending into the inner wall. The ribs form rounded bearing surfaces at the lowermost point of the container for supporting the container upright. The merger of the bearing surfaces with the inner wall is formed by two relatively inclined, i.e. non-tangent, surfaces forming interiorly directed corners to stiffen the base structure.

Further objects, features and advantages of the invention will become apparent from a consideration of the following description and the appended claims when taken in connection with the accompanying drawings.

DETAILED DESCRIPTION OF THE INVENTION

Figure 1:
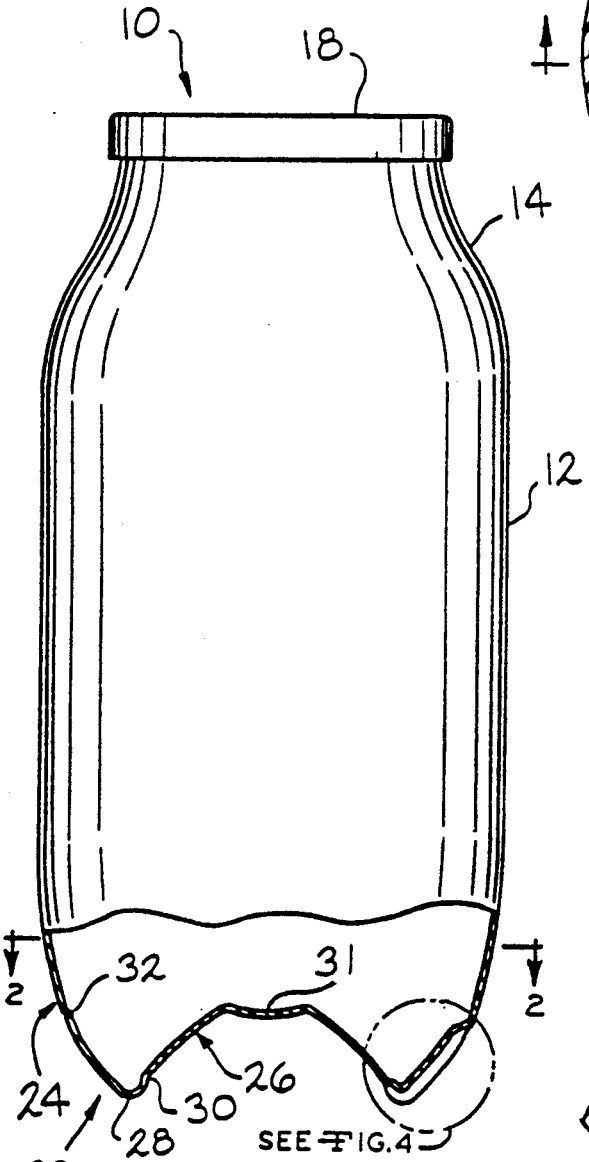
FIG. 1 is a partial sectional side elevational view of the container of the present invention.

The blow molded PET container with a ribbed base structure of the present invention is shown in FIG. 1 and designed generally at 10. Container 10 includes a generally cylindrical side wall 12 with a neck portion 14 at the upper end of the side wall leading to an open upper end. A resealable closure 18 is provided for closing the upper end of the container. Container 10 has a relatively large mouth or open upper end through which the contents can be poured. The large mouth is particularly useful for packaging of a flowable solid material such as ground coffee. The size of the open upper end can be either larger or smaller than that shown depending upon the particular product contained therein.

Extending downward from the lower end of side wall 12 is the base structure 22 closing the lower end of container 10. The base structure 22 is comprised of two main structures, a generally annular outer wall 24 and a generally circular inner wall 26 surrounded by the outer wall. The outer wall 24 can be generally described as being convex in shape when viewed from the exterior of the container while the inner wall 26, by protruding upwardly into the interior of container 10, can be generally described as being concave upwardly or inwardly. The circular area 31 at the upper end of the inner wall is at the center of the base structure.

The upper end of the outer wall merges smoothly with the lower end of the side wall 12. Outer wall 24 includes a radially inwardly directed step 32. As a result of step 32, the lower portion of the outer wall below step 32 is recessed slightly radially relative to the upper portion of the outer wall. The lower portion of the outer wall is formed with a plurality of hollow reinforcing ribs 34 projecting downwardly from the outer wall. The outer wall forms upwardly and inwardly projecting dividers 36 between the ribs 34. The ribs extend upwardly and outwardly over the lower portion of the outer wall and also extend through the merger of the inner and outer walls and upwardly and inwardly to the lower end of the inner wall.

Figure 2:
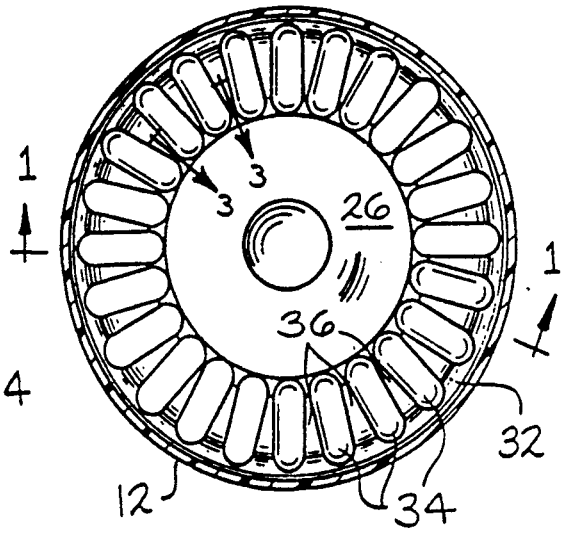
FIG. 2 is a sectional view of the container base structure as seen from substantially the line 2—2 of FIG. 1.

The lowermost point of the ribs form rounded bearing surfaces 28 upon which the container is supported upright on a horizontal surface. The rounded bearing surfaces 28 are relatively inclined to the inner wall 26 when viewed in a vertical section so as to from interiorly directed corners 30. The corners 30 function to stiffen the base structure and resist deformation. The ribs, as seen in FIG. 2, are of substantially constant width over their entire length. As a result, the dividers 36 between ribs gradually increase in width in a direction radially outwardly. Preferably, the ribs are at least twice as long as they are wide.

Figure 3:
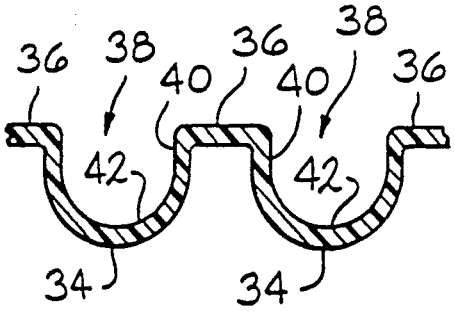
FIG. 3 is a sectional view of the base as seen from substantially line 3—3 of FIG. 2 illustrating the reinforcing ribs.
Figure 4:
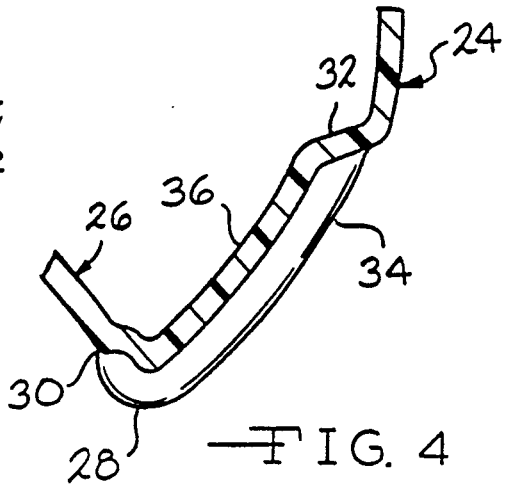
FIG. 4 is an enlarged view of the circled portion of the base structure shown in FIG. 1.

The ribs 34 have hollow interiors 38 as shown in section in FIG. 3. The ribs are formed by machining the bottom of the mold cavity with a ball cutter to form a plurality of grooves in the base of the mold into which the plastic resin is forced during the blow molding operation. The grooves in the mold cavity are machined to a depth equal to at least the radius of the ball cutter. The ribs thus have a hemispherical portion 42 and may also include a vertical wall segment 40, shown in FIG. 3, extending from the sides of the hemispherical portion 42. The vertical wall segments 40 or the nearly vertical segments at the end of the hemispherical portion act to substantially stiffen the outer wall and the bearing surfaces to strengthen the base structure and prevent the inner wall from "rolling out". Preferably, the number of ribs in the base structure exceeds 20 so as to produce a large number of stiffening corners 30 and vertical wall portions 40 to prevent deformation of the base structure. By forming relatively long narrow ribs, more ribs and vertical wall portions 40 can be formed to strengthen the base structure.

The ribs in the base structure of container 10 strengthen the base structure as compared to non-ribbed base structures in containers not intended for use of pressurized products. The ribs, however, are not as deep as the ribs or grooves found in a typical carbonated beverage container base structure. As a result, less plastic resin is required to form the base structure of container 10 than a comparable sized carbonated beverage container.

The container of the present invention, with a ribbed base structure is capable of accommodating products packaged with moderate internal pressures on the order of 30 to 50 psi, thus meeting the object of the invention.

It is to be understood that the invention is not limited to the exact construction illustrated and described above, but that various changes and modifications may be made without departing from the spirit and scope of the invention as defined in the following claims.

What is claimed is:

1. In a plastic container for a pressurized product, wherein said container has a hollow body with a generally cylindrical side wall and the base structure merging with said side wall, said base structure comprising:

an upwardly concave inner wall having upper and lower ends and a generally circular area at the upper end disposed substantially centrally of said base structure;

a convex outer wall of annular shape surrounding said inner wall, said outer wall having an upper end merging with said side wall and a lower end merging with the lower end of said inner wall; and a plurality of hollow reinforcing ribs projecting downwardly from said inner and outer walls, said ribs extending radially outwardly from an inner end merged with said inner wall to an outer end merged with said outer wall whereby said downwardly projecting ribs form bearing surfaces for contact with a supporting surface at the lower most points of said ribs, the exterior surface of the radially inner end of said ribs and the exterior surface of said inner wall being relatively inclined to one another when viewed in vertical cross section through said hollow ribs to form corners directed interiorly of said container to stiffen said base structure and to resist deformation thereof, the inner ends of said ribs being disposed sufficiently close to one another that said relatively inclined surfaces form a substantially continuous corner extending circumferentially about the lower end of said inner wall, said ribs being shallow in depth to provide sufficient stiffness to prevent base deformation by internal container pressures of approximately 30 psi.

2. The bottle of claim 1 wherein said ribs are of substantially uniform width in a direction radially outwardly of said base structure.

3. The bottle of claim 2 wherein said ribs, when viewed in cross section, form substantially vertical side walls to stiffen the outer wall and bearing surfaces.

4. The bottle of claim 1 wherein said plurality of ribs are more than 20 in number.

5. The bottle of claim 1 wherein said outer wall forms a radially inwardly directed step adjacent the merger of said rib outer ends with said outer wall.

* * * * *